US005890384A

United States Patent [19]

Bartel et al.

[11] Patent Number: 5,890,384

[45] **Date of Patent: *Apr. 6, 1999**

[54] POSITION-SENSOR SYSTEM FOR MOTOR-VEHICLE DOOR LATCH

[75] Inventors: Peter Bartel, Hattingen; Johannes-Theodor Menke, Velbert; Thorsten Torkowski, Duisburg, all of Germany

[73] Assignee: Kiekert AG, Heiligenhaus, Germany

[ * ] Notice: The term of this patent shall not extend beyond the expiration date of Pat. No. 5,862,691.

[21] Appl. No.: 950,792

[22] Filed: Oct. 16, 1997

[30] Foreign Application Priority Data

Oct. 26, 1996 [DE] Germany ..... 296 18 688 U

[51] Int. Cl.[6] ..... E05B 47/00

[52] U.S. Cl. ..... 70/264; 70/276; 70/DIG. 30

[58] Field of Search ..... 70/264, 276, 413, 70/DIG. 30; 340/426, 542

[56] References Cited

U.S. PATENT DOCUMENTS

| | | | |
|---|---|---|---|
| 3,124,950 | 3/1964 | Nallinger | 70/264 |
| 4,399,673 | 8/1983 | Gotanda | 70/276 |
| 4,565,994 | 1/1986 | Mochida et al. | 340/542 |
| 4,910,980 | 3/1990 | Katoh | 70/264 X |
| 5,551,267 | 9/1996 | Janssen et al. | 70/276 X |
| 5,566,562 | 10/1996 | Fujii | 70/276 X |

FOREIGN PATENT DOCUMENTS

| | | | |
|---|---|---|---|
| 2821901 | 12/1978 | Germany | 70/264 |
| 3941086 | 6/1991 | Germany | 70/276 |
| 2187227 | 9/1987 | United Kingdom | 70/277 |
| WO90/07045 | 6/1990 | WIPO | 70/276 |

*Primary Examiner*—Lloyd A. Gall
*Attorney, Agent, or Firm*—Herbert Dubno; Andrew Wilford

[57] ABSTRACT

A key cylinder rotatable about an axis and a motor-vehicle door latch having a housing are used with a position-sensing system having a selector nut made of a nonferromagnetic material and coaxial with and coupled to the key cylinder for joint rotation about the axis therewith, an actuating permanent magnet imbedded in the selector nut and movable in an orbit about the axis on rotation of the selector nut about the axis, and a hall-effect sensor mounted on the latch housing at a small spacing from the orbit.

6 Claims, 2 Drawing Sheets

POSITION-SENSOR SYSTEM FOR MOTOR-VEHICLE DOOR LATCH

FIELD OF THE INVENTION

The present invention relates to a motor-vehicle door latch. More particularly this invention concerns a system for sensing the position of the actuating element of such a door latch.

BACKGROUND OF THE INVENTION

A standard motor-vehicle door latch has a housing mounted on a door edge and holding a fork engageable about a bolt or eye itself mounted on a door post, a retaining pawl that can hold the fork in a position engaged around the bolt and holding it in the housing with the door latched, and various operating levers that allow the pawl to be actuated from inside and outside the door. Typically the latch also has a locking mechanism that can either block movement of or disconnect the operating levers and that includes a key-operated cylinder accessible from outside the door to lock and unlock its latch.

In today's cars it is furthermore standard to provide a central lock controller so that, for instance, when the driver's door is locked or unlocked, all the other doors of the vehicle are similarly locked or unlocked via respective actuators built into them. Furthermore such a system frequently has an antitheft mode in which it is impossible to open any of the vehicle's doors, even from inside the vehicle, so that in this antitheft mode the doors cannot be opened by clandestine means.

Thus in one such system the key is turned clockwise from a central starting position through about 30° to lock the latches. Turning the key the same distance counterclockwise both locks the latches and sets the antitheft mode. In another arrangement the key is turned 30° counterclockwise to lock the latches and then another 30° to set the antitheft mode. Another system locks the latches when the key is turned counterclockwise and then sets the antitheft position if the key is immediately returned to the center position and then turned back counterclockwise 30°. Normally a blinking pilot light is provided on the dashboard to indicate that the antitheft mode is set.

Such systems normally rely on mechanical microswitches to detect the setting of the latch. Other systems such as described in commonly owned patent application Ser. Nos. 08/653,771, 08/902,469, and 08/915,897 employ hall-effect sensors, but in a somewhat different application. All such systems are fairly complex.

OBJECTS OF THE INVENTION

It is therefore an object of the present invention to provide an improved position sensor for a motor-vehicle door latch.

Another object is the provision of such an improved position sensor for a motor-vehicle door latch which overcomes the above-given disadvantages, that is which is of simple construction yet which accurately reports the position of the latch key cylinder.

SUMMARY OF THE INVENTION

A key cylinder rotatable about an axis and a motor-vehicle door latch having a housing are used with a position-sensing system having according to the invention a selector nut made of a nonferromagnetic material and coaxial with and coupled to the key cylinder for joint rotation about the axis therewith, an actuating permanent magnet imbedded in the selector nut and movable in an orbit about the axis on rotation of the selector nut about the axis, and a hall-effect sensor mounted on the latch housing at a small spacing from the orbit.

Thus with this system the exact position of the key cylinder is detected by the hall-effect sensor without, however, any contact being made between the key cylinder and the sensor.

The magnet according to the invention is part-cylindrical, laminated, and centered on the axis. In addition the system has two such hall-effect sensors mounted on the latch housing spaced from each other and at a small spacing from the orbit. The magnet has two regions of different magnetic properties angularly spaced from each other relative to the axis. One of the regions is substantially thicker than the other region so that the field strength of the one region is greater than that of the other region. It is also possible for the one region to have a different polarity, or to be otherwise constructed to have a different field density.

The housing in accordance with the invention is made of plastic.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
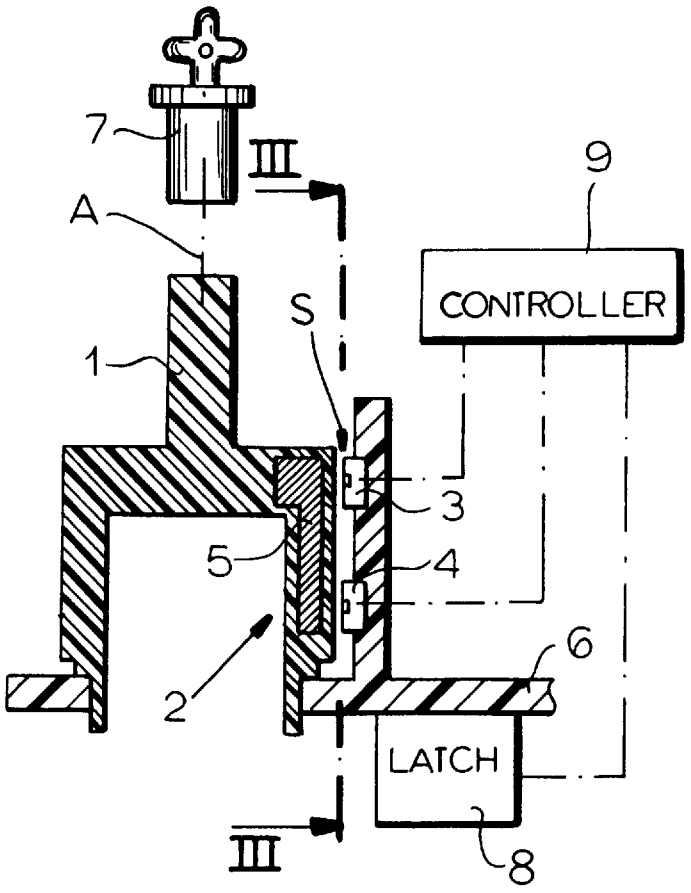
FIG. 2 s a sectional and diagrammatic view taken along line II—II of FIG. 1.
Figure 1:
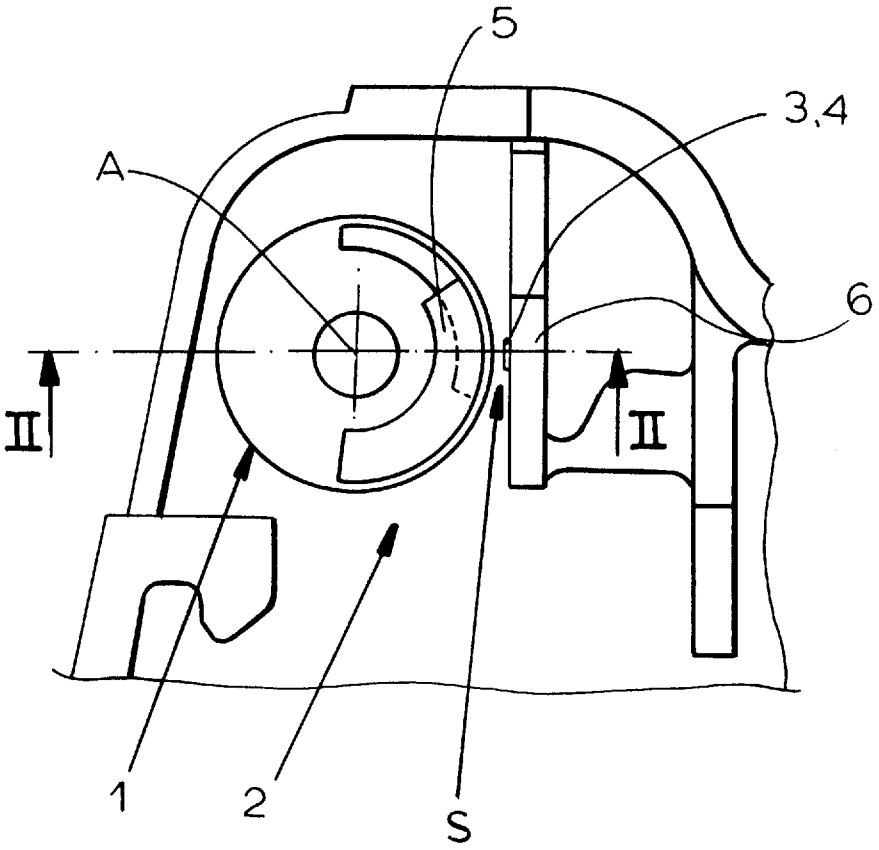
FIG. 1 is a side view of a detail of the position sensor according to the invention.
Figure 3:
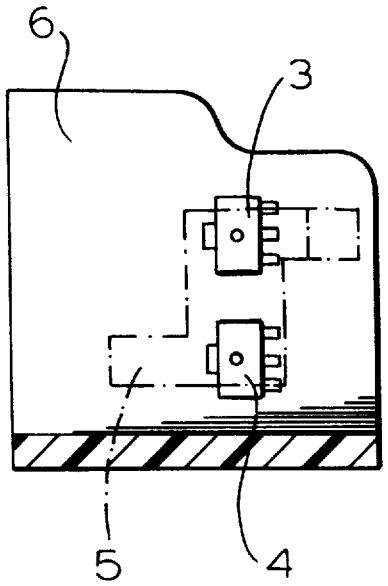
FIG. 3 is a section taken along line III—III of FIG. 2.
Figure 4:
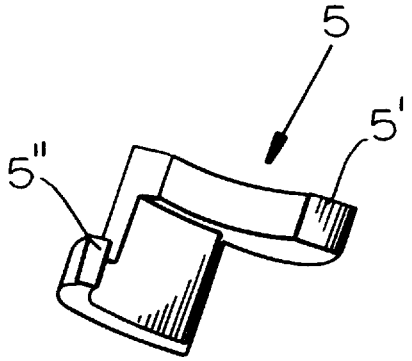
FIG. 4 a perspective view of the actuating magnet of the system of his invention.

As seen in FIGS. 1 through 3 a motor-vehicle door latch 8 has a plastic housing 6 in which is journaled a nonferromagnetic nut 1 for rotation about an axis A. A key-operated cylinder 7 is connected along an axis A with the nut 1 for joint coaxial rotation therewith, normally between a center null position, a right-hand locking position, and a left-hand antitheft position. The latch 8 includes the standard fork, pawl, and operating levers (not shown).

According to the invention a part-cylindrical and laminated permanent magnet 3 that is polarized radially of the axis A is imbedded in the nut 1 and imbedded in the latch housing 6 immediate adjacent it are two axially spaced hall-effect sensors 3 and 4 connected to a central controller 9 of the lock system. The magnet 3 has as shown in FIG. 3 an angularly extending relatively thick arm 5' that is of high flux density and moves past the sensor 3 and a relatively thin arm 5" that similarly moves past the sensor 4. Each sensor 3 and 4 includes a hall-effect transistor whose resistance changes as it is traversed by a magnetic field as well as an amplifier and comparator for emitting an output, typically a pulse, when the respective transistor is traversed by a magnetic field exceeding a predetermined flux density.

The controller 9 serves to set the other latches of the motor vehicle having the latch 6 in the same position as the latch 6. Thus if the latch 6 is physically set in the locked position by the cylinder 7, the other latches 6 of the vehicle are set by respective actuators in their locked positions. Similarly unlocking the latch 6 with the cylinder 7 unlocks the other latches and setting the latch 6 in the antitheft position sets the antitheft mode all around.

We claim:

1. In combination with a key cylinder rotatable about an axis and a motor-vehicle door latch having a housing, a position-sensing system comprising:

a selector nut made of a nonferromagnetic material and coaxial with and coupled to the key cylinder for joint rotation about the axis therewith;

an actuating permanent magnet imbedded in the selector nut and movable in an orbit about the axis on rotation of the selector nut about the axis; and means including a hall-effect sensor mounted on the latch housing at a small spacing from the orbit.

2. The combination defined in claim 1 wherein the magnet is part-cylindrical, laminated, and centered on the axis.

3. The combination defined in claim 1 wherein the means includes two such hall-effect sensors mounted on the latch housing spaced from each other and at a small spacing from the orbit.

4. The combination defined in claim 3 wherein the magnet has two regions of different magnetic properties spaced from each other relative to the axis.

5. The combination defined in claim 4 wherein one of the regions is substantially thicker than the other region, whereby the field strength of the one region is greater than that of the other region.

6. The combination defined in claim 1 wherein the housing is made of plastic.

* * * * *